United States Patent [19]

Nagano et al.

[11] Patent Number: 4,910,941

[45] Date of Patent: Mar. 27, 1990

[54] METHOD AND APPARATUS FOR FITTING A TUBE ON A CONTAINER OR THE LIKE

[75] Inventors: Satoshi Nagano; Yoshinori Hotta; Nobuyuki Takagaki, all of Osaka, Japan

[73] Assignee: Fuji Seal Industry Co., Ltd., Osaka, Japan

[21] Appl. No.: 270,626

[22] Filed: Nov. 14, 1988

[30] Foreign Application Priority Data

Nov. 20, 1987 [JP] Japan ..... 62-294654

[51] Int. Cl.[4] ..... B67B 5/00

[52] U.S. Cl. ..... 53/291; 53/296; 53/585

[58] Field of Search ..... 53/296, 291, 399, 136, 53/585

[56] References Cited

U.S. PATENT DOCUMENTS 2,765,607 10/1956 Aguilar et al. ..... 53/291
3,594,975 7/1971 Abrecht ..... 53/585 X
4,016,704 4/1977 Fujio ..... 53/296 X
4,148,171 4/1979 Westlund ..... 53/291 X
4,600,371 7/1986 Fresnel ..... 53/585 X
4,806,187 2/1989 Fujisawa ..... 53/291

FOREIGN PATENT DOCUMENTS 4935752 9/1974 Japan .

*Primary Examiner*—James F. Coan
*Attorney, Agent, or Firm*—Birch, Stewart, Kolasch & Birch

[57] ABSTRACT

A folded tube is paid out downward through the rotation of opposing feed rollers, and fitted on a mandrel member. The tube is then fitted on the mandrel and cut to a predetermined length by a cutting device disposed between the feed rollers and the mandrel. Subsequently the tube cut to the predetermined length is drawn downward along the mandrel by the rotating members and the tube is unfolded. Finally, the sufficient unfolded tube is dropped down from the mandrel and fitted on a cap portion of a bottle or container to be sealed.

3 Claims, 5 Drawing Sheets

METHOD AND APPARATUS FOR FITTING A TUBE ON A CONTAINER OR THE LIKE

BACKGROUND OF THE INVENTION

1. Field of the Invention

This invention relates to a tube fitting method applicable mainly for cap sealing and labeling operations with respect to containers such as bottles and the like and to an apparatus for carrying out in the method.

2. Description of the Prior Art

Means for fitting a tube on a container or the like have been known in the art. A typical example is disclosed in Japanese Patent Publication No. 49-035752.

Briefly, the prior art includes, as FIG. 4 illustrates, a flat folded continuous tube 1 fitted on and guide along a mandrel *7e*. The tube 1 is drawn downward in its unfolded condition to a position below the mandrel *7e* by a pair of downward drawing belts *9e*, *9e* separately provided, and a lower portion of the tube 1 so drawn down is cut by cutting means 13*e* to a predetermined length. The cut tube 1*e* is fitted on a packaging container 16 supplied at a position below the mandrel *7e* and is subsequently passed through the step of heat shrinking or the like as required before it is used as a cap seal or a label bearing a trade name or other information.

However, with the above described prior art arrangement, it is impossible to employ as cutting means 13*a* cutter of simple construction as, for example, one having two blades engageable with each other, since the tube 1 is cut to the predetermined length when it is in an unfolded condition after its passage over the mandrel *7e*. In order to cut the unfolded tube properly while preventing it from being refolded, it is undesirably necessary to employ cutting means of a complicated construction such as a rotary cutter in which a cutter blade turns around the tube while it is in rotation.

Therefore, the prior art apparatus is considerably complicated with respect to its component for tube cutting. This naturally results in poor efficiency in the manufactured of the apparatus. Further, cutting the tube on its outer periphery as it is drawn in an end open condition entails considerable time required in tube cutting operation, which naturally means poor efficiency in the tube fitting operation.

Another problem is that it is very difficult to cut a thin flexible tube neatly while it is held open. As such, its cut end is unsightly, and naturally the cut portion also looks poor in its finished state.

SUMMARY OF THE INVENTION

This invention is directed to overcoming the above-mentioned problems with the prior art, and accordingly the invention is intended to eliminate the necessity of using a rotary cutter of complicated construction as a tube cutting means, thereby to realize simplified construction of the tube cutting means.

The invention is also intended to reduce the time requirement for a tube cutting operation and achieve improvement in the cut surface finish, thereby enabling a proper tube fitting operation.

This invention is directed to eliminating the foregoing problems with the prior art arrangement by carrying out tube cutting at a stage prior to the tube being passed over the mandrel, rather than cutting the tube as it is unfolded after its passage over the mandrel as in the prior art arrangement, and by subsequently drawing the cut tube downward to a position below the mandrel.

Accordingly, the method of tube fitting in accordance with the invention comprises transferring a flat folded continuous tube 1 to a tube unfolding mandrel 7 so that it is fitted on the mandrel 7, cutting the continuous tube 1 to a desired length at a position above the mandrel 7, and drawing the cut tube 1*a* downward along the mandrel 7, thereby causing the cut tube 1*a* to be unfolded over its full length so that it is fitted on a packaging container 16 or the like that is positioned below the mandrel 7.

The tube fitting apparatus in accordance with the present invention, as developed for purposes of carrying out the above mentioned method, comprises feed rollers 3, 3 disposed above a tube unfolding mandrel 7 to enable a flat folded continuous tube 1 to be transferred and supplied to the mandrel 7, rotating means 9, 9 for drawing the tube downward over the mandrel 7, which rotating means 9, 9 are movable at least at their respective upper ends toward and away from the mandrel 7 so as to enable the tube 1 transferred and fed from the feed rollers 3, 3 to be fitted on the mandrel 7 and which are rotatable in contact with the mandrel 7 so as to enable the fitted tube to be drawn downward from the mandrel 7, and cutting means 13 disposed between the feed rollers 3, 3 and the mandrel 7 for cutting the tube 1 as it is fed from the feed rollers 3, 3 toward the mandrel 7.

Therefore, in the tube fitting method of the present invention, the tube 1*a* fitted on the mandrel 7 and cut to the predetermined length can be unfolded to provide adequate opening by drawing it downward to a position below the mandrel 7 so that it can be fitted on a packaging container 16 or the like put in position below the mandrel 7. After being fed to and fitted on the mandrel 7 in its continuous state, the tube 1 is cut at a position above the mandrel 7, but it is noted that at such position above the mandrel 7 the tube 1 is not yet unfolded. Thus, it is unnecessary to use a rotary cutter or the like of complicated construction for the purpose of cutting the tube 1, and prompt and neat cutting can be carried out by using a cutter of such simple construction that two cutter blades slide past each other.

According to the tube fitting apparatus of the present invention, the flat folded continuous tube 1 is transferred and supplied to the mandrel 7 by the feed rollers 3, 3 for being fitted on the mandrel 7. In this conjunction, only if at least the respective upper portions of the rotating means 9, 9 for drawing the tube downward which are in contact with the mandrel 7 are kept away from the mandrel 7, the rotating means 9, 9 can be prevented from interfering with the operation of tube 1 fitting on the mandrel 7. Subsequently, the tube 1 can be cut to the predetermined length by the cutting means 13 provided between the feed rollers 3, 3 and the mandrel 7, and the tube 1 so cut can be drawn downward in its unfolded and wide open state to a position below the mandrel 7 by actuating the draw-downward rotating means 9, 9 held in abutment with the mandrel 7. In this way, a series of operating stages in the tube fitting method of the present invention can be properly carried out.

DETAILED DESCRIPTION

Figure 1A:
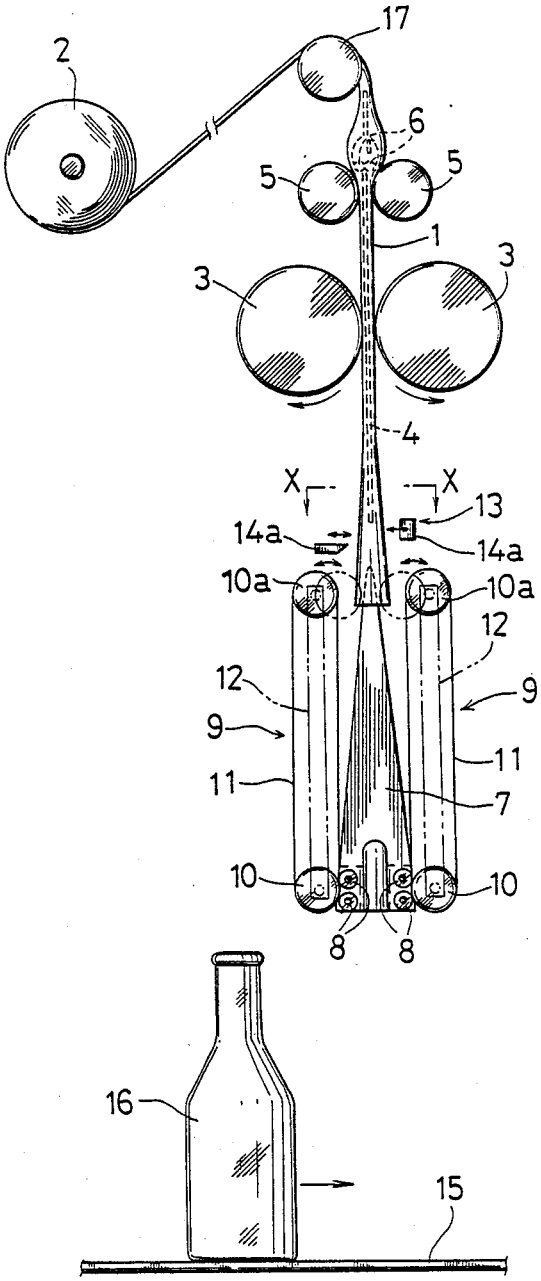
FIG. 1 illustrates one embodiment of the tube fitting apparatus in accordance with the invention, FIG. 1 (A) being a front view thereof, FIG. 1 (B) being a sectional view in side elevation thereof, FIG. 1 (C) being an enlarged section taken along the line X—X in FIG. 1 (A), FIG. 1 (D) being a front view showing one form of an inner guide.
Figure 1B:
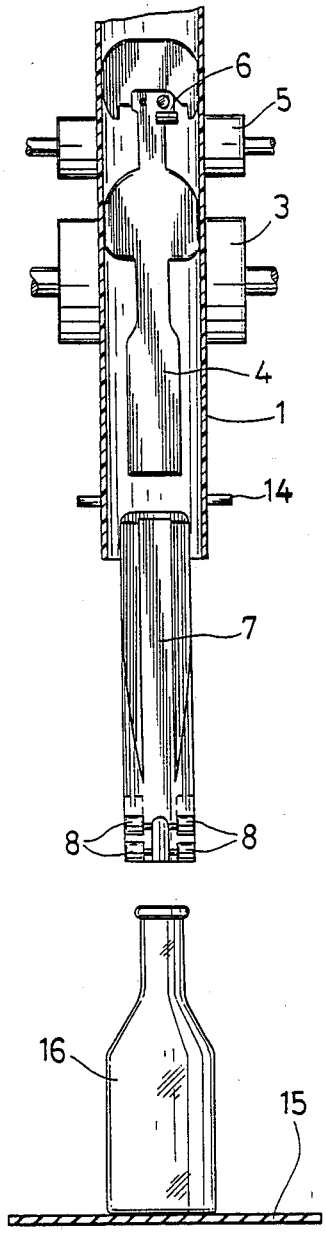
Figure 1C:
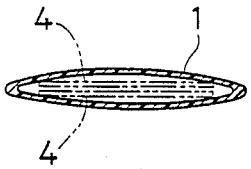
Figure 1D:
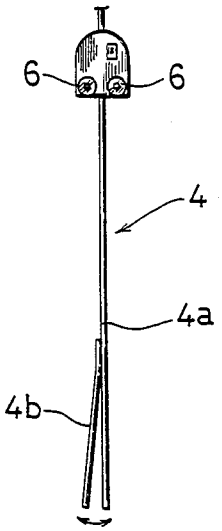

Embodiments of the invention will now be described with reference to the accompanying drawings.

One embodiment of the apparatus according to the present invention will be first explained. In FIG. 1, numeral 1 designates a thin flexible continuous tube made of a synthetic resin material which is in a flat folded condition. Numeral 2 designates a roll in which the continuous tube 1 is wound. Designated by 3, 3 are a pair of feed rollers rotatable for successively paying out the continuous tube 1 from the roll 2 via a guide roller 17 or the like. The feed rollers 3, 3 may be driven independently or may be driven in conjunction with other drive units of the apparatus.

Numeral 4 designates a thin flat plate spring-shaped inner guide for slightly opening the tube 1 fed through the feed rollers 3, 3 the inner guide 4 comprising a body plate 4*a* and a spring 4*b* attached to one side of the body plate 4*a* as FIG. 1 (D) shows. The inner gide 4, with its upper portion locked by a pair of backup rollers 5, 5 disposed above the feed rollers 3, 3, is inserted in the continuous tube 1 paid out through the feed rollers 3, 3. Shown by 6 are rollers disposed on an upper portion of the inner guide 4 which are adapted to turn idle on the backup rollers 5, 5 to prevent the inner guide 4 from falling by being caught between the backup rollers 5, 5 while in rotation.

Numeral 7 designates a mandrel disposed below the feed rollers 3, 3 for tube unfolding, which has its sides slanted into a downwardly reverse tapered configuration. At lower opposite sides of the mandrel 7 there are rotatably supported small rollers 8, 8, upper and lower, in pairs.

Numerals 9, 9 designate a pair of downward tube drawing belts (which represent by way of example the rotating means for downward tube drawing according to the invention) disposed at opposite sides, right and left, of the mandrel 7 so as to hold the mandrel therebetween. The downward tube drawing belts 9, 9 each comprises pulleys 10, 10*a*, upper and lower, and a belt body 11 trained over the pulleys 10, 10*a* for cyclic rotational movement. The lower pulleys 10, 10 are each rotatably supported in position by being held in contact with small rollers 8, 8 of the mandrel 7. The upper pulleys 10*a*, 10*a* are each rotatably supported by a lever 12 pivotable about a supporting shaft of the lower pulley 10, 10 so that they are pivotally movable toward and away from opposite upper sides of the mandrel 7. It is noted that pivotal movement of the upper pulleys 10*a*, 10*a* is effected as required by such reciprocating drive means as a cylinder (not shown) connected to the lever 12.

Numeral 13 designates a cutter (corresponding to the cutting means of the invention) disposed at a position slightly above the mandrel 7, which comprises two cutter blades 14*a*, 14*a* placed in an opposed relation with respect to each other and adapted to cut tube 1 when they are moved toward each other. Shown by 15 is a transport conveyor horizontally extending below the mandrel 7 for sequentially transporting thereon container bottles 16 to a position below the mandrel 7.

The tube fitting apparatus of the invention is of the above described arrangement. One example of the tube fitting method of the invention will be explained in which the above described apparatus is employed.

The continuous tube 1 is first paid out downward from the roll 2 through rotation of the feed rollers 3, 3 so that, as FIG. 1 illustrates, it is fed and transferred to the mandrel 7 for being fitted thereon. In this case, the continuous tube 1 is opened, though slightly, at its leading end by the action of the inner guide 4, so that it can be smoothly fitted on the mandrel 7. By moving respective upper portions of the downward tube drawing belts 9, 9 away from the mandrel 7 as shown, it is possible to fit the tube 1 on the mandrel by a suitable length as it is fed through the feed rollers 3, 3 without involving any undue catch relative to the downward drawing belts 9, 9.

Figure 2:
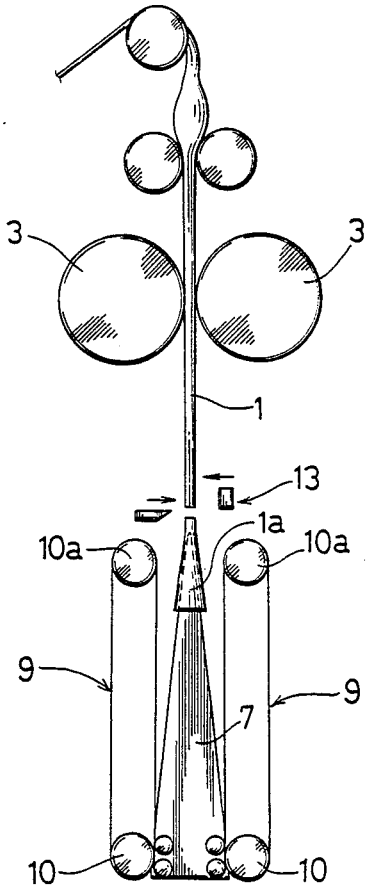
FIGS. 2 and 3 are explanatory views showing the steps of tube fitting operation.

Subsequently, the cutter 13 disposed above the mandrel 7 is actuated to cut the continuous tube 1 as FIG. 2 shows. In conjunction, and as can be seen from FIG. 1 (C), at a position directly above the mandrel 7 the tube 1 is not open wide and is still in a narrow folded condition. Accordingly, the tube 1 can be easily and quickly cut by means of the two cutter blades 14, 14*a*, and a very neat cut effect can be obtained with respect to the cut end of the tube 1. During a cutting operation, it is preferable that the gap between the spring plate 4*b* and body plate 4*a* of the inner guide 4 is closed by bringing them toward each other thereby making it possible to perform the tube cutting operation in more satisfactory manner.

Figure 3:
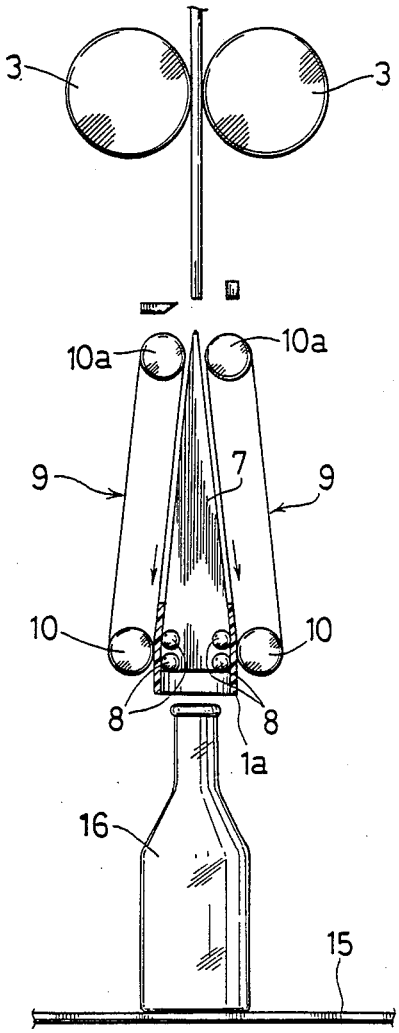

Subsequently, as FIG. 3 shows, upper pulleys 10*a*, 10*a* of the downward tube drawing belts 9, 9 are moved inwardly and the belts 11 are driven to rotate while the pulleys 10*a*, 10*a* are in abutment with sides of the mandrel 7, whereby tube 1*a* cut to the predetermined length is lowered to a position below the mandrel 7. Through passage of the tube 1*a* over the mandrel 7 as it is lowered along the mandrel 7, the tube 1*a* is opened wide to provide sufficient opening over its full length and is dropped down while keeping itself in such condition.

Therefore, the tube 1*a* drawn downward by the downward drawing belts 9, 9 is allowed to drop on a container bottle 16 transported on the transport conveyer 15 in synchronization with the lowering operation of tube 1*a*, so that it is fitted on a cap portion of the container bottle 16. It should be noted, however, that during rotation of the lower pulleys 10, 10 of the downward drawing belts 9, 9, the small rollers 8, 8 of the mandrel 7 which are in contact with the pulleys 10, 10 are only allowed to turn idle so that the mandrel 7 is prevented from dropping down.

In the above described embodiment, an inner guide 4 is provided at a level above the mandrel 7 so that the tube 1 fed toward the mandrel 7 through the feed rollers 3, 3 can be accurately fitted on the mandrel 7, but in the present invention, such means as inner guide 4 is not essential. The inner guide 4 is unnecessary in a case where the tube 1 is characteristically such that its opening will not completely be closed as the tube 1 is cut by the cutter 13. It is noted, however, that as an alternative to the inner guide 4, means for forcibly opening the flat tube 1 through vacuum suction of the front end of the tube 1 at both sides thereof may be employed which is, for example, in the form of a vacuum type rotary belt with an open/close mechanism.

Figure 4:
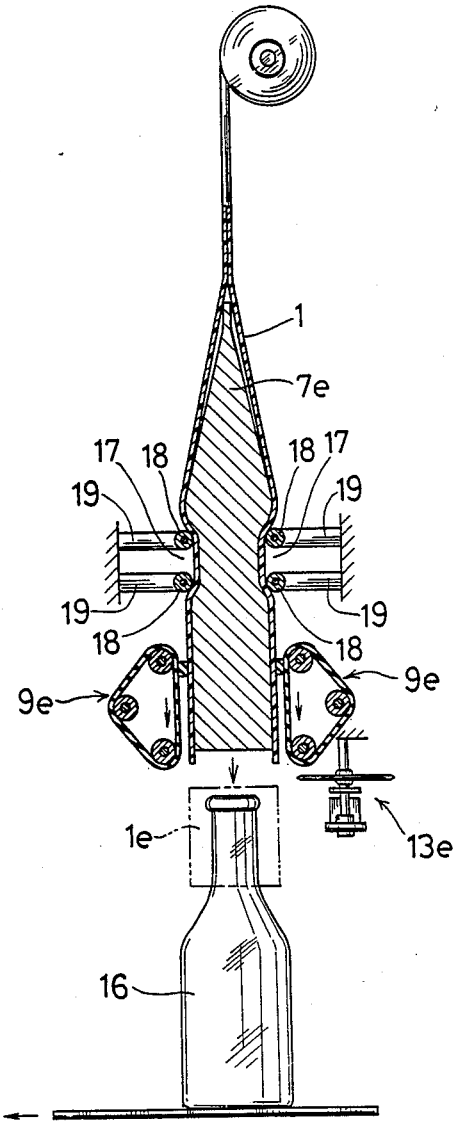
FIG. 4 PRIOR ART
FIG. 4 is a sectional view showing the prior art arrangement.

In the above embodiment, in order to provide simplified support means for the mandrel 7, only respective upper portions of the downward drawing belts 9, 9 are pivotally movable toward and away from the mandrel 7, the mandrel 7 being securely supported in position by lower pulleys 10, 10 fixed in position at lower sides; but the invention is not limited by this arrangement. For example, as in FIG. 4 showing the prior art arrangement, it is quite possible to employ means such as bars 19 having a roller 18 at their front ends which are in engagement with recesses 17 formed on sides of the mandrel 7 so that the mandrel 7 is held in position. However, such means involve a difficulty that the rollers 18 may interfere with operation for fitting of tube 1 on the mandrel 7. In such a case, it is preferable to use an arrangement whereby the tube fitted on the mandrel 7 is positively transferred downward through rotation of the rollers 18. Of course, in the above embodiment, the downward drawing belts 9, 9 as a whole may be arranged to be movable toward and away from the mandrel 7.

The rotating means 9, 9 for drawing the tube fitted on the mandrel 7 downward are not limited to belt type means as are employed in the above described embodiment, but may instead be of the roller type. In essence, the draw-downward rotating means employed in the apparatus of the present invention may be of any arrangement such that at least upper portions of the means are movable toward and away from the mandrel 7 so as to enable the tube 1 transferred and fed from the feed rollers 3, 3 to be fitted on the mandrel 7 and such that the means are rotatable while in contact with the mandrel 7 so as to allow the tube fitted on the mandrel 7 to be drawn downward to a position below the mandrel 7. Therefore, the means may not necessarily be provided in pairs of two as in the above described embodiment, but may be in any desired number.

The arrangement of the cutting means 13 for tube cutting or of the mandrel 7 according to the present invention is in no way limited to that in the above described embodiment. All such arrangements may be modified or altered in design within the spirit and scope of the present invention. For example, the mandrel 7 may be arranged to be movable straightforwardly or swingable in horizontal directions at the same speed as the packaging containers 16 in order to further speed up tube fitting operation. In this invention, there is no particular limitation with respect to the material and size of the tube 1. Further, kinds and types of objects to which tube fitting is applicable are by no means limited to containers such as bottles and the like.

Further, the applicability of the tube fitting method according to the present invention is not limited to the use of the tube fitting apparatus described.

As described above, the present invention provides means for fitting a part of a flat continuous tube on a mandrel, then cutting a non-opened portion of the tube at a level above the mandrel, and subsequently drawing the cut tube downward to a container or the like placed below the mandrel. Therefore, the invention does not require the use of a rotary cutter of such complicated construction as is conventionally used for cutting the tube after being unfolded and opened wide, thus making it possible to considerably simplify the construction of means applicable for tube cutting through the use a cutter of such a simple construction that two cutter blades are arranged to operate in crossing relation. According to the invention, therefore, it is now possible to attain simplicity in the apparatus construction and good reduction in the cost of manufacturing the apparatus.

Furthermore, as earlier described, according to the present invention, a tube is cut in its unopened state and, therefore, it is possible to perform tube cutting operation more speedily than in the case where the tube is cut after it is unfolded and opened wide. This insures higher-speed operation and higher efficiency in a series of tube fitting, better finishing of cut tube ends, and improved appearance of the tube fitted objects when used as cap seals or labels, thus contributing toward increased commercial value.

With the tube fitting apparatus according to the invention, at least an upper portion of the rotating means for downward tube drawing is held away from the mandrel, a continuous tube is fitted on the mandrel by means of the feed rollers, and then the tube is cut to the desired length. Subsequently, the cut tube is caused by said rotating means to drop on a packaging container placed below the mandrel. Thus, the apparatus can be advantageously employed in carrying out the tube fitting method of the invention in a smooth and proper mode of operation.

We claim:

1. An apparatus for fitting a flat folded continuous tube member on a container comprising:
   - a tube unfolding mandrel for receiving said flat folded continuous tube member;
   - means for transferring said tube member from a supply source to said tube unfolding mandrel;
   - a flat thin plate-like inner guide insertable in the tube member fed from said means for transferring to slightly open up the tube member;
   - inner guide means for initially separating said tube member fed by said means for transferring to said tube unfolding mandrel;
   - idle rollers positioned on an upper portion of said inner guide means for assisting transport of said tube member over said inner guide means;
   - backup rollers disposed above said means for transferring for locking said idle rollers;
   - opposing rotating means for drawing said tube member downward, said opposing rotating means being movable at least at respective upper ends toward and away from said mandrel member so as to enable said tube member to be fitted on said mandrel member and which are rotatable in contact with said mandrel member so as to enable the fitted tube member to be drawn downward from said mandrel member; and
   - cutting means disposed between said means for transferring and said mandrel member for cutting said tube member as it is fed from said means for transferring toward said mandrel member.

2. An apparatus according to claim 1, wherein said means for transferring is a pair of feed rollers positioned above said mandrel member.

3. An apparatus for fitting a tube on container, comprising:
   - feed rollers disposed above a tube unfolding mandrel, said feed rollers enabling a flat folded continuous tube to be transferred to the mandrel;
   - opposing rotating means for drawing the flat folded continuous tube downward, said opposing rotating means being movable at least at their respective upper ends toward and away from the mandrel so as to enable the tube transferred by the feed rollers to be fitted on the mandrel, and said feed rollers being rotatable in contact with the mandrel so as to enable the fitted tube to be drawn downward from the mandrel; and cutting means disposed between said feed rollers and the mandrel for cutting the tube as it is fed from the feed rollers to the mandrel;

wherein said opposing rotating means for drawing the flat folded continuous tube downwards includes upper and lower pulleys disposed on opposing sides of the mandrel, and belt members trained over the upper and lower pulleys, the lower pulleys being rotatably supported in position by being disposed at lower opposite sides of the mandrel to thereby hold the mandrel in position, the upper pulleys being pivotable toward and away from upper opposite sides of the mandrel.

* * * * *